US006004432A

United States Patent [19]

Page et al.

[11] Patent Number: 6,004,432

[45] Date of Patent: Dec. 21, 1999

[54] SHEET TURN WITH VECTORED AIR SUPPLY

[75] Inventors: Robert E. Page, Davis, Ill.; Brian C. Adamski, Edgerton, Wis.

[73] Assignee: Beloit Technologies, Inc., Wilmington, Del.

[21] Appl. No.: 09/014,751

[22] Filed: Jan. 28, 1998

[51] Int. Cl.[6] ..... B65H 57/14

[52] U.S. Cl. ..... 162/281; 162/193; 162/271; 226/7; 226/97.1; 226/97.3; 226/196.1; 242/615.12; 242/615.21

[58] Field of Search ..... 162/280, 193, 162/281, 282, 271

[56] References Cited

U.S. PATENT DOCUMENTS

| | | | |
|---|---|---|---|
| 4,342,413 | 8/1982 | Reba | 226/97 |
| 4,919,319 | 4/1990 | Ford et al. | 226/197 |
| 5,209,387 | 5/1993 | Long et al. | 226/97 |
| 5,235,733 | 8/1993 | Willbanks et al. | 28/105 |
| 5,464,143 | 11/1995 | Hansen | 226/119 |
| 5,471,766 | 12/1995 | Heikkilä | 34/461 |
| 5,480,086 | 1/1996 | Nakashima et al. | 226/97 |

OTHER PUBLICATIONS

Smook, G.A., Handbook for Pulp & Paper Technologists, 2nd ed., (Vancouver, 1992) 316, 317, and 319, 1992.

*Primary Examiner*—Peter Chin

[57] ABSTRACT

In a papermaking machine for forming tissue paper, a turning bar is disposed having a curved surface about which a web of tissue paper is turned. The bar has an internal air plenum which supplies air to two sets of holes or slots. The first set is arranged to direct air normal to the curved surface of the bar or in the machine direction, the second set is arranged to direct air toward the edges of the tissue which is turned around the bar. The second holes or slots produce air jets which apply a cross machine direction tension to the web which prevents wrinkling of the web. The first set of holes or slots forms jets of air that prevent the tissue web from contacting the turning bar.

1 Claim, 2 Drawing Sheets

SHEET TURN WITH VECTORED AIR SUPPLY

BACKGROUND OF THE INVENTION

1. Field of the Invention

The present invention relates to devices for handling paper webs which support a web on a cushion of air in general, and to devices for supporting tissue paper webs in particular.

2. Description of the Prior Art

Lightweight webs of paper with high absorbency are created by pressing or thru-air drying the wet web and placing it onto a large diameter dryer roll and scraping the dried web off the roll with a doctor blade. The scraping of the dryer roll results in creping of the web. Creping shortens the machine direction length of the web while at the same time making the web thicker and also breaks some of the fiber bonds within the paper. These changes in the web make it better able to absorb water. Creped paper webs are fabricated into products such as facial tissues, paper napkins, paper towel, and toilet paper.

The creping action of the doctor blade results in a web which is easily stretched in the machine direction and to a lesser extent in the cross machine direction. However, stretching of the tissue web is undesirable because it reduces the absorbency of the web. For this reason it is important to avoid excessive pulling or tensioning of the web such as can result when the web is turned or directed around one or more rollers, foils or turning bars. One solution is to utilize turning bars or foils with air jets which support the web on a cushion of air. This type of air support is often used with coated paper when handling the paper before the coating has dried completely.

Tissue paper, because of its ability to stretch, can easily become wrinkled as the unconstrained paper moves over these supports, leading to wrinkles in the finished product. Wrinkles lower the product's functionality by reducing absorbency and detracting from the appearance of the products formed from tissue paper.

U.S. Pat. No. 4,342,313 to Reba discloses a turning bar where more air is supplied to the center of the web by varying the width of a slit along the length of the turning bar to establish a desired air flow profile. Reba suggests that by making the slit wider in the center than at the edges, more air cushioning in the middle of the web is obtained which creates cross machine direction spreading and improved guiding of the web.

Long et al. U.S. Pat. No. 5,209,387 describes an apparatus for conveying photographic film where the web of film is controlled with reasonable precision by adjusting the gas pressure or changing the size or angle of the gas apertures.

What is needed is a simple turning bar about which a web of tissue paper can be turned without wrinkling or significant stretching.

SUMMARY OF THE INVENTION

The turning bar of this invention incorporates a bar with a curved surface about which a web of tissue paper is turned. The bar has an internal air plenum which supplies air to two sets of holes. The first set is arranged to direct air normal to the curved surface of the bar, the second set is arranged to direct air toward the edges of the tissue sheet which is being turned around the bar. The second set of holes are directed in the cross machine direction and produce air jets which apply a cross machine direction tension to the web which prevents wrinkling of the webs. Air discharged from the first set of holes forms jets that prevent the tissue web from contacting the turning bar.

It is a feature of the present invention to provide a papermaking machine for the formation of creped tissue paper web which prevents wrinkling of the web.

It is a further feature of the present invention to provide a web turning device for a tissue web which does not contact the web but which constrains the web in the cross machine direction.

It is another feature of the present invention to provide an air cushioned turning bar which controls cross machine direction tension in a tissue paper web.

Further objections, features and advantages of the invention will be apparent from the following detailed description when taken in conjunction with the accompanying drawings.

DESCRIPTION OF THE PREFERRED EMBODIMENT

Figure 1:
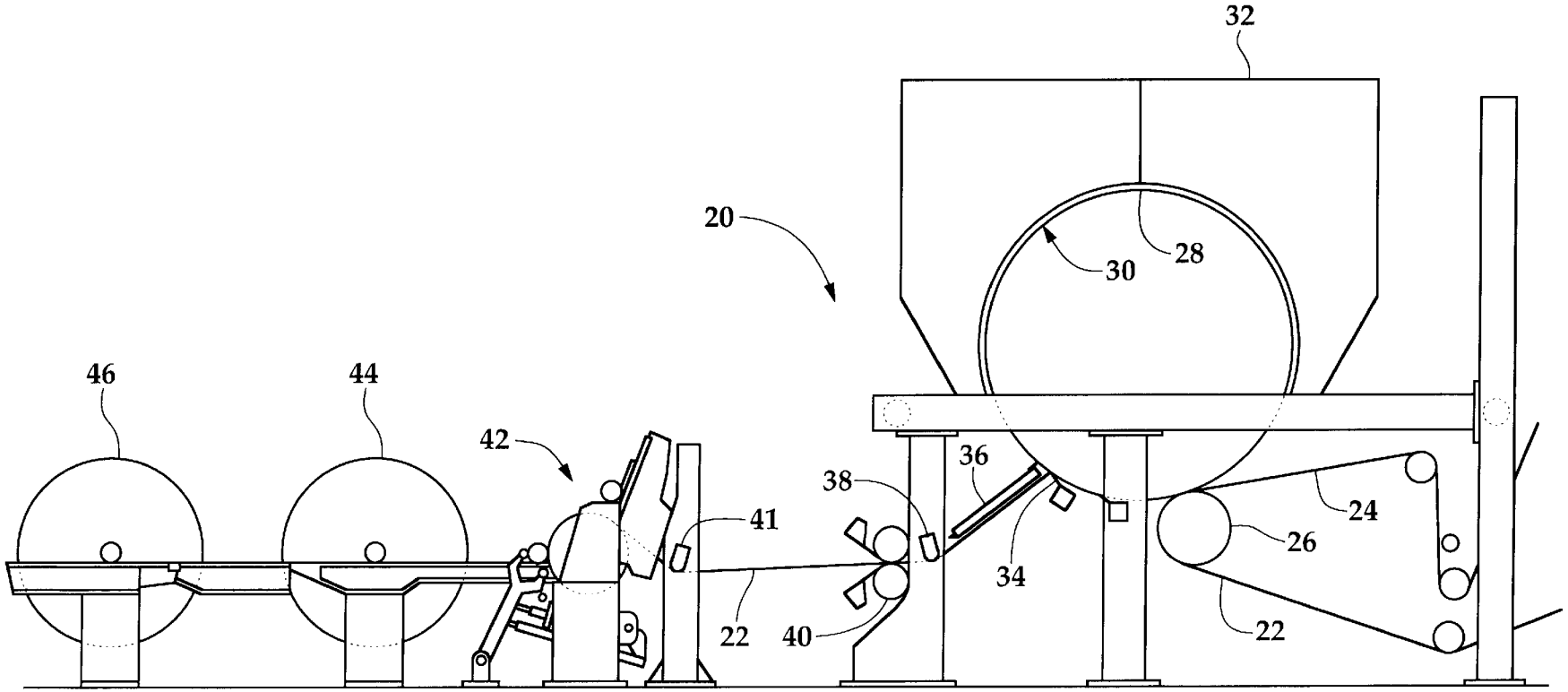
FIG. 1 is a side elevational schematic view of a papermaking machine which incorporates improved turning bars.
Figure 2:
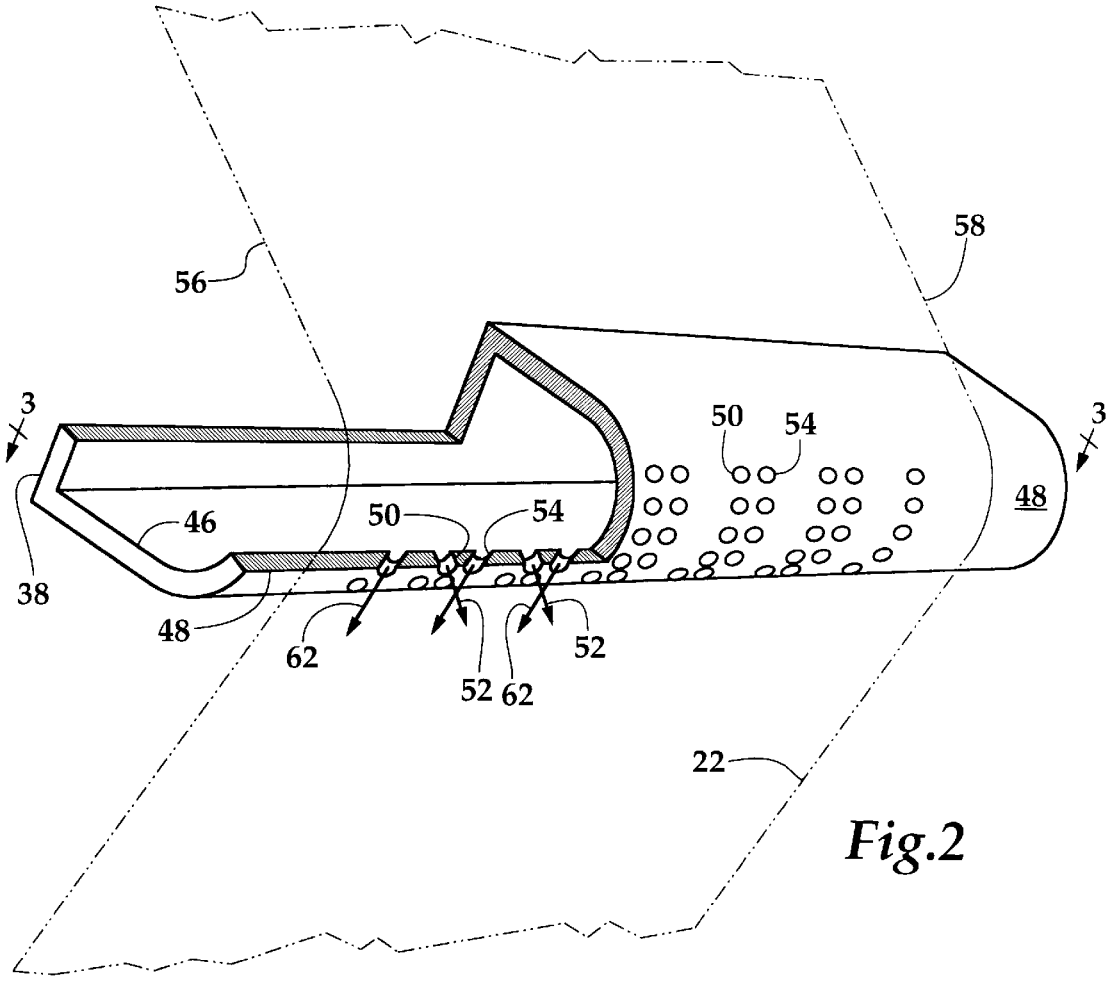
FIG. 2 is an isometric view, partially cut away, of the turning bar of FIG. 1.
Figure 3:
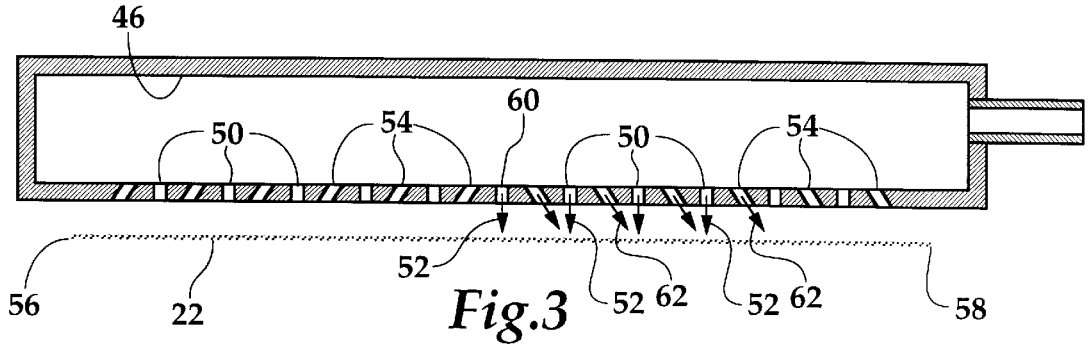
FIG. 3 is a cross-section view of the turning bar and tissue web of FIG. 2 taken along section line 3—3.

Referring more particularly to FIGS. 1–3 wherein like numbers refer to similar parts a portion of a papermaking machine 20 is shown in FIG. 1. A web 22 from a former, thru-air dryer or pressing section (not shown) is transported by a press felt or fabric 24 to a press roll 26 which transfers the web 22 to a Yankee dryer roll 28. The web 22 is brought into intimate engagement with the surface 30 of the Yankee dryer 28. The web 22 is rapidly dried by heat transfer from the Yankee dryer 28 and from an air cap 32 positioned over the top of the Yankee dryer 28. The web is scraped off the surface 30 of the dryer 28 by a doctor blade 34. A foil 36 such as described in co-pending application entitled Web Stabilizing Device, application Ser. No. 08/920,157 filed Aug. 26, 1997, which is incorporated herein by reference, is positioned to deflect air from the outer surface of the web 22 and to support the web 22 as it is removed from the dryer 28 by the doctor 34.

An air turning bar 38 directs the web through a calendar 40. The web 22 is again redirected by a second turning bar 41 to a reel or winding device 42 where the web is wound into reels 44.

The turning bars, 38, 41 are of a unique design as shown in FIGS. 2 and 3. Each turning bar 38 has a central plenum 46 which is supplied with air under pressure. The plenum 46 has portions which face the web which form a surface 48 defining a portion of a cylinder or aerodynamic surface. The pressurized air is blown through openings 50, 54 in the cylindrical or aerodynamic surface 48 over which the web 22 turns. One set of holes 50 is arranged perpendicular to the cylindrical surface or directed in the direction of sheet travel and serves to create jets of air, indicated by arrows 52, which support the web 22 and prevent it from coming into contact with the cylindrical surface 48. The second set of holes 54 is arranged to introduce air at an angle from the normal to the surface 48. The second holes 54 are angled toward the edges 56, 58 of the web 22 such that the holes 54, as shown in FIG. 3, which are to the right of the center 60 are directed toward the right-hand edge 58. Similarly holes 54 which are to the left of the center 60 are directed toward the left-hand edge 56. Although the holes 50 and 54 are shown as being in the same plane, holes 50 and 54 can be arranged in separate planes such that the air through holes 54 will not cross or interfere with the air traveling through holes 52 in the cross machine direction. Additionally, although only one plenum 46 is shown, it is envisioned that multiple plenums could be provided separated by a buffer or wall (not shown). Multiple plenums would allow for independent control of air being supplied through the sets of holes 50 and 54.

The flow of air toward the edges 56, 58 of the web 22 results in the web being held under light cross machine direction tension which prevents wrinkles from forming in the web 22. The jets, indicated by arrows 62, produced by the air flowing through the second sets of holes 54, may be directed just toward the sides 56, 58 or may be angled in the machine direction in addition to being toward the sides of the web 22.

The air pressure will typically be from about less than one pound per square inch to about two to three pounds per square inch but, generally the amount of air pressure needed depends on the characteristics of the web and the configuration and design of the equipment being used. The hole diameter or slot width will typically be between 1 and 60 thousandths of an inch. The number of holes or slots which are angled versus the number of holes or slots which are normal to the cylindrical surface may be varied, but, generally, there are more holes or slots normal to the cylindrical surface or in the direction of sheet travel than there are holes or slots being angled in the cross-machine direction. The preferred angle between a normal to the surface and the jets indicated by arrows 62 should be about five degrees to about fifty degrees.

The machine direction width of the cylindrical or curved surface 48 may vary between about one-half inch and twenty to thirty inches. The cross machine direction length of the turning bar 38 will be proportional to the width of the paper web being handled. Typically, tissue paper webs 22 are from one hundred to three hundred inches wide.

The angle turned by the web 22 about the cylindrical or curved surface 48 of the turning bar 38 will typically be between five and forty degrees but can be up to almost one hundred and eighty degrees. The cylindrical or curved surface will be one-half a cylinder if the turning angle is one hundred and eighty degrees. If the angle through which the paper is turned is smaller, only a smaller sector of a cylinder or curved surface may be used to form the cylindrical or curved surface over which the web 22 is turned.

It is understood that the invention is not limited to the particular construction and arrangement of parts herein illustrated and described, but embraces such modified forms thereof as come within the scope of the following claims; for example, where reference is made to holes, slots could be used in place of holes.

What is claimed is:

1. A tissue paper papermaking machine comprising:

a Yankee dryer, the dryer having a cylindrical surface;

a tissue paper web having side edges and intimately engaged with the cylindrical surface of the Yankee dryer;

a doctor blade engaged against the surface of the Yankee dryer and in creping engagement with the tissue paper web;

a foil positioned in a downstream machine direction from the doctor blade, the foil supporting the tissue paper web;

a turning bar positioned downstream in the machine direction from the foil and extending in the cross-machine direction, the turning bar having a center and portions defining a smoothly curved surface engaged with the tissue paper web, wherein the tissue paper web is wrapped about the curved surface between about five to less than one hundred and eighty degrees;

wherein the turning bar has a cross machine direction air plenum for holding a supply of pressurized air;

a multiplicity of holes or slots comprising two sets extending in the turning bar between the curved surface and the air plenum for directing streams of pressurized air against the tissue paper web disposed for passing thereover, wherein each of a first set of the multiplicity of holes or slots is inclined from a local normal to the curved surface, the inclination of the holes or slots on one side of the turning bar center being toward a corresponding tissue paper side edge and the inclination of the holes or slots on the other side of the turning bar center being toward the other corresponding tissue paper side edge and wherein each of a second set of holes or slots is disposed normal to a plane tangent to the curved surface, whereby the tissue paper web can be supported as it passes over the curved surface of the turning bar, and be subjected to a cross machine direction tension, to prevent wrinkling of the web.

* * * * *